United States Patent [19]

Aleksandrow

[11] 4,154,063

[45] May 15, 1979

[54] APPARATUS FOR FORMING AND HARVESTING ICE SLABS IN AN ICE MAKING MACHINE

[76] Inventor: Jerry Aleksandrow, 2950 Bixby La., #217, Boulder, Colo. 80302

[21] Appl. No.: 793,843

[22] Filed: May 5, 1977

Related U.S. Application Data

[63] Continuation-in-part of Ser. No. 684,299, May 7, 1976, abandoned.

[51] Int. Cl.[2] ..... F25C 1/12

[52] U.S. Cl. ..... 62/138; 62/238; 62/320; 62/352

[58] Field of Search ..... 62/352, 138, 320 X, 62/347, 348, 238 E

[56] References Cited

U.S. PATENT DOCUMENTS

| | | | |
|---|---|---|---|
| 2,345,678 | 4/1944 | Lamar | 62/320 X |
| 2,612,030 | 9/1952 | Ploeger | 62/352 |
| 2,613,506 | 10/1952 | Cook | 62/352 X |
| 2,887,852 | 5/1959 | Thomas | 62/352 X |
| 3,003,327 | 10/1961 | Cox et al. | 62/347 X |
| 3,055,185 | 9/1962 | Lundstrom | 62/138 |
| 3,130,556 | 4/1964 | Goldsborough | 62/352 X |
| 3,187,516 | 6/1965 | Lundstrom | 62/352 X |
| 3,913,349 | 10/1975 | Johnson | 62/352 |

*Primary Examiner*—William E. Wayner
*Assistant Examiner*—William E. Tapolcai, Jr.
*Attorney, Agent, or Firm*—Crandell and Polumbus

[57] ABSTRACT

An ice forming plate member pivots upon formation of a slab of ice of predetermined weight thereon and upon pivoting, a switch senses the pivoting and controls a refrigeration system for harvesting the ice slab by conducting heat to the ice forming plate member to release the slab of ice formed. Biasing means counterweight the ice forming plate member to prevent pivoting prior to the formation of an ice slab of predetermined weight, with the weight being approximately correlated with the thickness of the ice slab. Two or more ice forming plate members may be mechanically connected in parallel for forming two ice slabs approximately simultaneously. Heat for defrosting the two ice slabs is supplied at different rates to the two ice forming plate members to release one of the ice slabs at a different time than the other ice slab is released. The method disclosed involves sensing the weight of the ice slab and correlating the weight of the ice slab to an approximate thickness and harvesting the ice slab upon it attaining a predetermined thickness.

11 Claims, 8 Drawing Figures

APPARATUS FOR FORMING AND HARVESTING ICE SLABS IN AN ICE MAKING MACHINE

BACKGROUND OF THE INVENTION

FIELD OF THE INVENTION

This is a continuation-in-part of application Ser. No. 684,299, filed May 7, 1976, now abandoned.

This invention relates to ice making, and more particularly to an ice making method and machine in which an ice slab is formed from a flow of water, and the ice slab is thereafter divided into ice cubes.

BRIEF DESCRIPTION OF PRIOR ART

Conventional prior art ice cube making machines employ an interrelated group of cooperating components which principally consist of a flat smooth surface chilled ice forming plate over which aerated water is flowed to freeze as an ice slab, an ice cube forming grid for dividing the ice slab into cubes, and a group of various separate and intricate freezing and ice harvesting controls, such as thermostats, ice thickness sensing mechanisms, rotating timing devices and the like. These prior art ice making machines present several distinct disadvantages.

One significant disadvantage in prior art ice making machines relates to thermostatic ice harvest and freezing controls. The thermostatic controls are directly sensitive to altitude, location, vibration and calibrations, and are expensive to manufacture or replace, and usually are difficult to accurately adjust for the desired thickness of the ice slab produced. Other typical controls such as the rotating apparatus and timing devices are also impractical since they are relatively expensive, complicated, difficult to calibrate and generally do not withstand continued use over relatively long periods of time. In short, typical ice harvest and freezing controls significantly reduce reliability of operation and increase the cost of ice making machines.

Another disadvantage in prior art ice making machines relates to the means for forming the ice slab into cubes. Typical examples of such devices include hot electric wire grids which are driven by expensive power converter transformers, which require silver contacts between the ice cutting wires and which require electric power supply distributors, all of which are constantly exposed to wetness and are therefore subject to oxidation. In operation, the electric grid generally does not conduct enough electricity to keep the grid hot enough to melt the slabs of ice as they are delivered, which results in delay in the formation of more ice. The final undesirable effect is a build up of ice on the grid with the eventual malfunction of the machine.

Another disadvantage of prior art ice making machines is the smoothness of the ice forming plate surface which delays the release of the ice slab formed thereon. The flat smooth surface of the plate fits perfectly to the ice formed on the plate which generally causes the ice slab to adhere to the plate for an unnecessary amount of time after the ice forming plate has been heated sufficiently to release the slab of ice.

SUMMARY OF THE INVENTION

It is a general object of the present invention to provide a new and improved ice making apparatus which materially reduces or largely eliminates the foregoing disadvantages and objections in prior art ice making machines, and which provides many advantages and benefits of operation that have heretofore been unobtained.

In accordance with the present invention as it relates to apparatus for forming ice cubes from water, an ice forming plate member is operatively connected to pivot when a slab of ice of predetermined thickness accumulates thereon due to freezing of water flowing over the plate member, and a sensing means is associated with the ice forming plate member to sense a predetermined degree of pivoting and to control the formation and release of the ice slab on the ice forming plate member. A control signal is supplied when the ice forming plate member pivots the predetermined degree to terminate the flow of water over the chilled ice forming plate member and to supply heat to the ice forming plate member for releasing the slab of ice thereon. A plurality of grooves formed in the ice forming plate member contribute to releasing the slab of ice, and a cube cutting grid forming a part of the condenser of the refrigeration system is positioned to receive the slab of ice and to melt the slab of ice into cubes. A plurality of ice forming plate members are operatively connected to operate in unison, and the sensing means controls the delivery of heat to each plate member in a manner to release one of the slabs of ice at a different time as compared to another slab of ice. After release of the ice slabs, the ice forming members pivot to their original position, the flow of water over the plate members is initiated, and the refrigeration system begins chilling the ice forming plate members to form new ice slabs. A counterweight device biases the ice forming plate members against pivoting until ice slabs of a predetermined weight or thickness have been formed.

The method of the present invention involves sensing the weight of the slab of ice frozen on at least one ice forming plate member, correlating the weight of the slab of ice to its approximate thickness, and thereafter simultaneously terminating the water flow over each ice forming plate member and melting the portion of each ice slab attached to the ice forming plate member to release the slab.

By the present invention, the formation and harvesting of the slab of ice is effectively controlled by one sensing means which may take the form of a simple and reliable electrical switch, thereby significantly enhancing the reliability of operation as compared to prior art apparatus involving relatively complicated and intricate control devices and systems. Furthermore, by controlling the formation and harvesting of the ice slabs according to weight or thickness, more ice may be produced since the harvesting operation begins immediately after the slab attains its predetermined desired thickness and new ice slabs begin to freeze shortly after harvesting of the previously formed slabs. The sensing means in the form of an electric switch significantly reduces the cost of the ice formation and harvest control of the refrigeration system. The thickness of the ice, which is related to its weight, is easily adjusted by the counterweight member of the biasing means for reliable and accurate selection of the ice slab's desired thickness. Heat from the condenser of the refrigeration system at the cube cutting grid melts the slab of ice into cubes making the refrigeration system more efficient. The grooves in the ice forming plate members promote a hydroplaning effect for quickly releasing a slab of ice.

The features which characterize the invention are defined in the annexed claims. A preferred embodiment of the invention itself, as to its organization and method of operation, together with further objects and advantages of the present invention, will best be understood by reference to the following brief description of the drawings and detailed description of the preferred embodiment.

DETAILED DESCRIPTION OF THE PREFERRED EMBODIMENT

Figure 1:
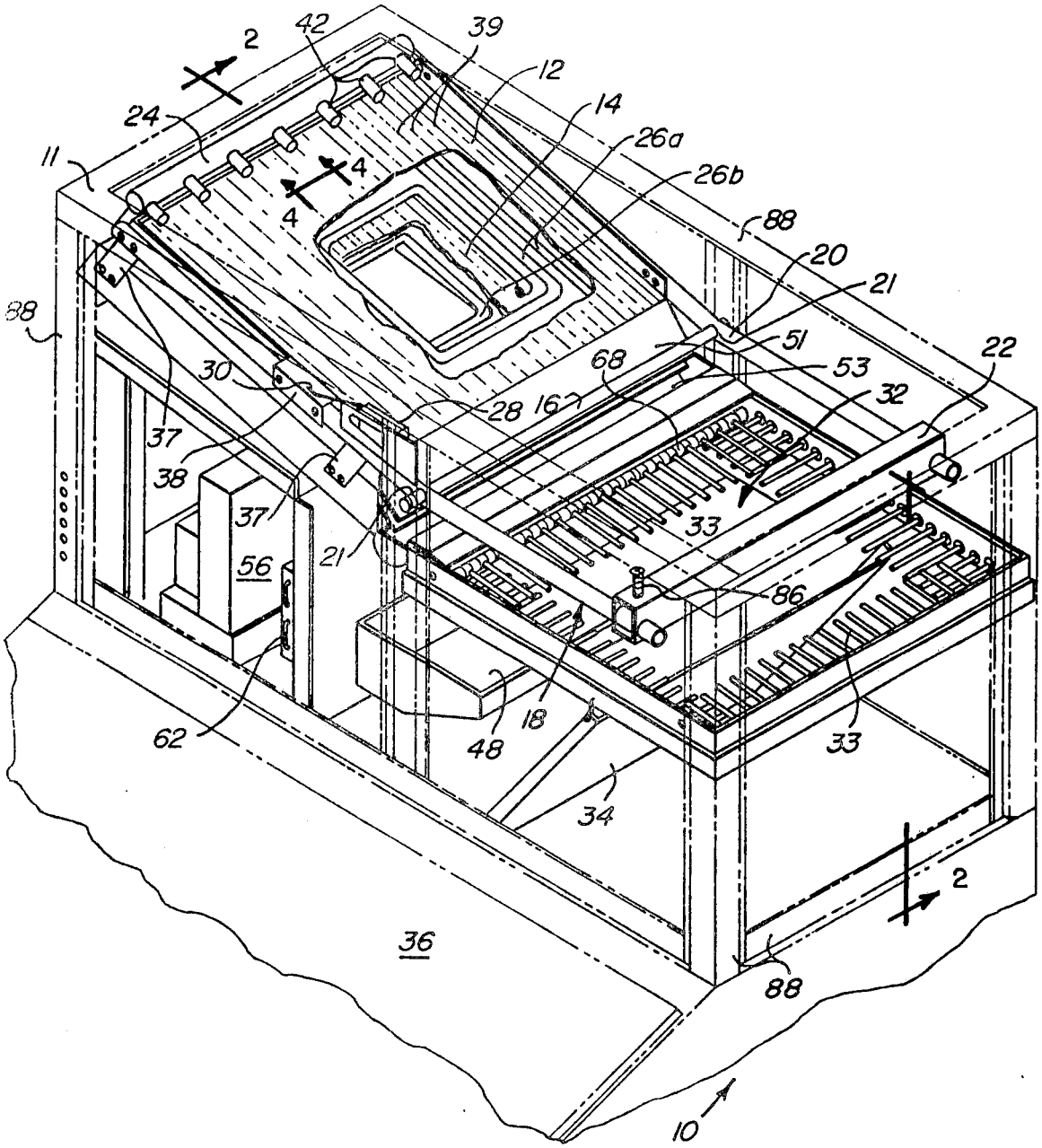
FIG. 1 is a fragmentary perspective view of an ice making apparatus employing the present invention, with certain portions removed for clarity.
Figure 2:
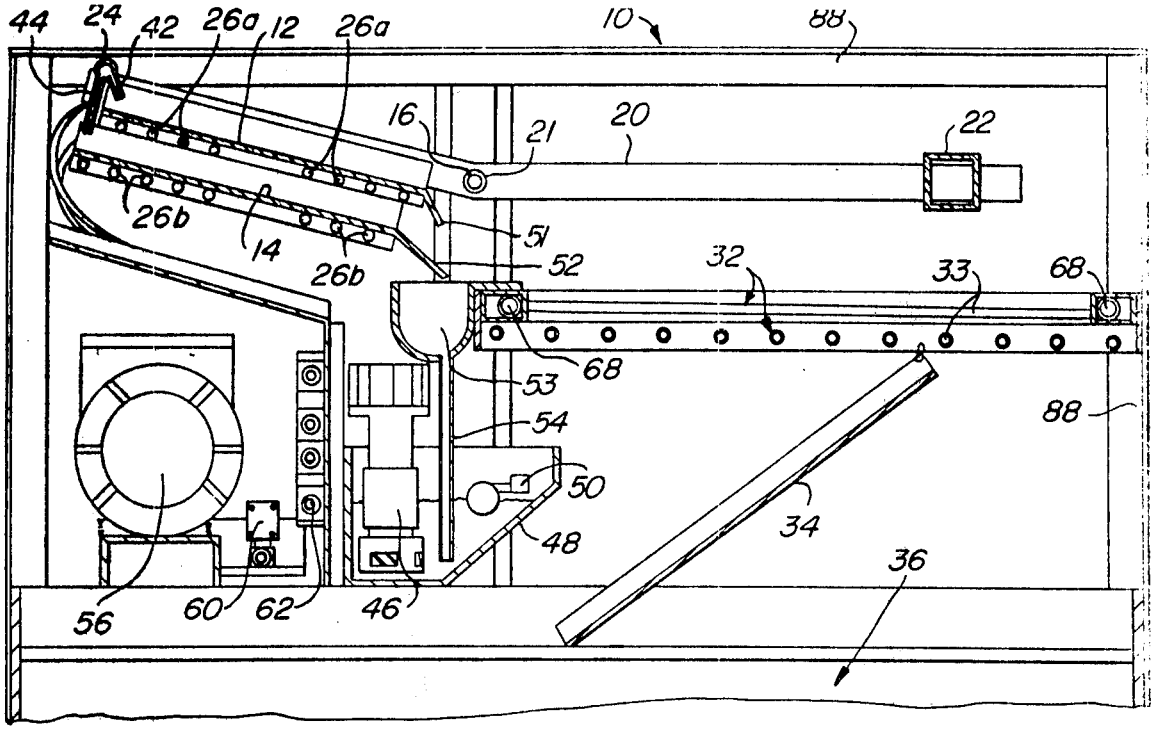
FIG. 2 is a vertical section view substantially in the plane of line 2—2 of FIG. 1.

Basic organization of the invention in an ice making machine 10 can be understood from FIGS. 1 and 2. Two ice forming plate members 12 and 14 are connected essentially in parallel to one another, and these ice forming plate members are operatively connected to pivot about one of their ends. Means for pivoting the ice forming members 12 and 14 comprise a transverse pivot bar 16 and longitudinally extending arm members 18 and 20 attached on opposite transverse sides of the ice forming plate member 12. Holes 21 formed in the arm members 18 and 20 receive the pivot bar 16 and allow the arm members to pivot about bar 16. The portions of arm members attached to the ice forming plate members are angled to position the ice forming plate members at an incline at all times. To bias the ice forming plate members in a maximum inclined position, a counterweight member 22 is attached to the arm members 18 and 20 on the opposite side of the pivot bar 16 from the ice forming plate members 12 and 14. A flow of water is delivered to the ice forming plate members 12 and 14 by a water distributing manifold 24 positioned at the upper inclined end of the plate members, from which water flows in a thin sheet over the ice forming plate members. Coils **26*a* and 26*b*** of the evaporator of the refrigeration system chill the ice forming plate members to freeze the water into ice.

Figure 5:
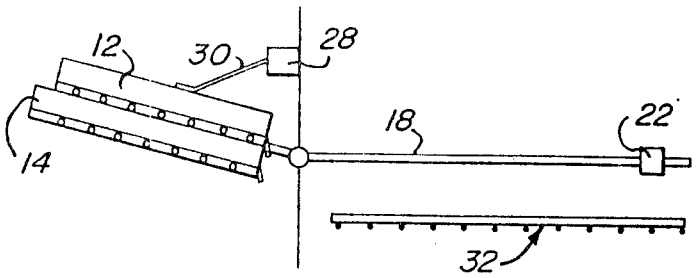
FIGS. 5, 6, 7 and 8 are schematic representations of portions of apparatus of FIG. 1 illustrating operation of the present invention in sequential stages and functions.
Figure 6:
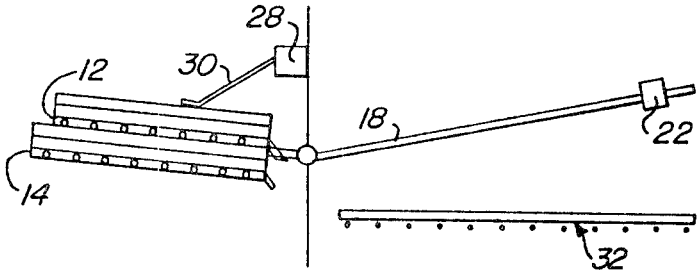
Figure 7:
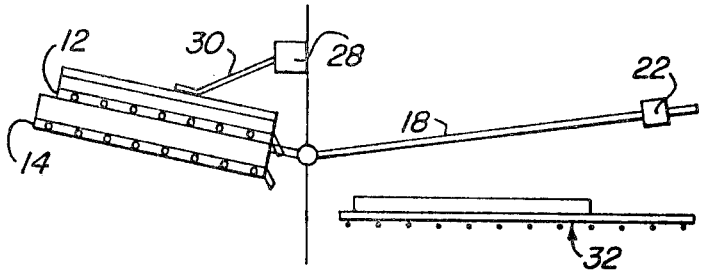
Figure 8:
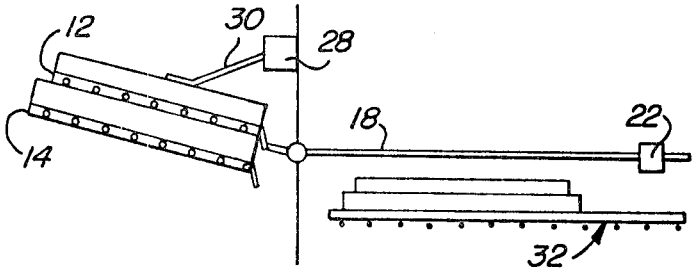

Ice is formed in a slab of essentially uniform thickness on the ice forming plate members, and the thickness of the slab increases so long as the flow of water is maintained. Upon the ice slabs attaining sufficient weight to overcome the moment of the counterweight member 22 about the pivot bar 16, the ice forming plate members pivot or deflect downward to a minimum inclined position (FIG. 6). A microswitch 28 having a feeler 30 senses the predetermined degree of pivoting of the ice forming plate members and provides a control signal for terminating the flow of water from the water distributing manifold 24 and for heating or defrosting the ice forming plate members to release the slabs of ice thereon. Heat from the refrigeration system is conducted to the ice forming plate members, with a greater rate of heat being conducted to the plate member 14. The ice attaching the slab to the ice forming plate member 14 is melted and the lower slab of ice slides from the inclined plate member 14 onto a cube cutting grid 32 positioned to receive the ice slab (FIG. 7). With release of the ice slab from the plate member 14, the plate members 12 and 14 pivot to a position intermediate the maximum and minimum inclined positions (FIG. 7). The microswitch 28 continues to provide the control signal delivering heat to the plate members 12 and 14, and shortly thereafter, the ice slab attached to plate 12 is released (FIG. 8). The second ice slab is received on top of the first ice slab already present on the cube cutting grid 32. After release of the slab from the plate member 12, the moment from the counterweight member 22 pivots plate members 12 and 14 to the maximum inclined position (FIGS. 5 and 8). The microswitch 28 and feeler 30 sense the initial maximum inclined position and immediately initiate the delivery of water over the ice forming plate members 12 and 14 and control the refrigeration system to immediately start conducting heat away from the plate members 12 and 14 to initiate another ice forming and harvesting cycle.

The cube cutting grid 32 is formed of refrigerant tubes 33 which comprise a portion of the condenser in the ice maker refrigeration system of the ice making apparatus 10. The tubes 33 of the grid 32 are positioned to cross one another in mutually perpendicular relation at intervals corresponding to the desired size of the ice cubes to be formed. The tubes 33 conduct hot gas to melt and divide each ice slab into the ice cubes. The ice cubes fall down chute 34 and are received within an insulated compartment 36 of the apparatus 10 where the cubes are stored until use.

Brackets 37 shown in FIG. 1 connect the ice forming plate members 12 and 14 in a parallel and separated relationship, and cause the plate members to pivot together. A smooth feeler plate 38 is positioned on arm member 18 to allow the feeler 30 of the microswitch 28 to rest thereon, and consequently, control operation of the microswitch according to the degree of pivot of the ice forming plate members attached to the arm members.

Figure 4:
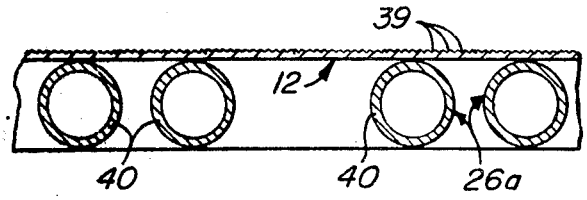
FIG. 4 is a vertical section view taken substantially in the plane of line 4—4 of FIG. 1.

The ice forming plate members 12 and 14 have a plurality of grooves 39 formed in the surface on which the ice attaches, as is shown in FIGS. 1 and 4. The grooves 39 are essentially parallel and oriented longitudinally in the direction in which the ice slab is discharged. The grooves cause hydroplaning of the ice slab as it is discharged and thereby promote a more rapid discharge of the ice slab from the ice forming plate members than can be obtained without the grooves.

Tubes 40, shown in FIG. 4 of the evaporator coil **26*a* are retained in close adjacency with the ice forming plate member 12, or make contact with the plate member 12, to establish a heat conductive relationship for removing heat from the plate member 12. A similar arrangement exists for the tubes of the evaporator 26*b* and the ice forming plate member 14. The evaporator coils 26*a* and 26*b* are connected in the refrigeration system by flexible hoses (not shown) to allow the ice forming plate members 12 and 14** to pivot.

Shown in FIGS. 1 and 2 the water distributing manifold 24 is positioned stationarily within the apparatus 10 and contains a plurality of generally equally spaced upper flow nozzles 42 and lower flow nozzles 44 supplying the flow of water to the ice forming plate members 12 and 14, respectively, when in the maximum inclined position. Water is supplied to the water distributing manifold 24 by a water pump 46. The water pump 46 is positioned in a tank 48 having a float valve 50 for regulating the level of water in the tank 48. A conventional source supplies water to be controlled by the float valve 50 in tank 48. Upon operation of the pump 46, a thin film of water flows from the upper inclined ends of the ice forming plate members to their lower ends. A portion of this thin water film freezes and the remainder of the water drains from lips 51 and 52 at the lower end of the plate members 12 and 14 into a trough 53 positioned therebelow to receive the run-off. The run-off water collected in trough 53 is conducted through conduit 54 to the tank 48 for recirculation over the ice forming plate members 12 and 14 by the pump 46. Operation of the water supply to the ice forming plate members is controlled by selective switching of electrical power to the pump 46.

Figure 3:
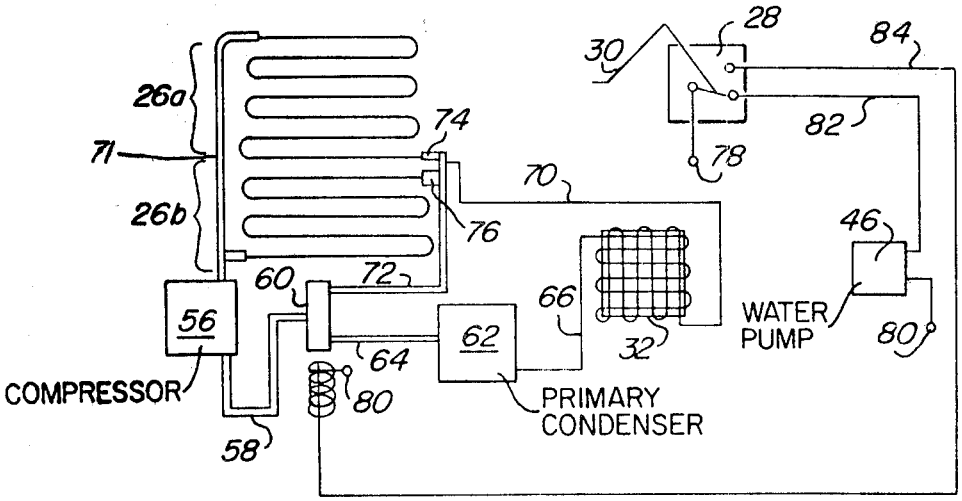
FIG. 3 is a combined schematic view illustrating the refrigeration system and the electrical controls employed in the apparatus of FIG. 1.

The refrigeration system of the ice maker 10, shown best in FIG. 3, includes compressor means 56 for compressing refrigerant gas and supplying hot compressed refrigerant gas through conduit 58 to electrically controlled solenoid valve 60. When not electrically energized, the valve 60 conducts the hot compressed refrigerant gas to a primary condenser 62 through conduit 64. The conduit 66 conducts the refrigerant from the primary condenser 62 to the cube cutting grid 32. The cube cutting grid may comprise the plurality of equally spaced and transversely crossing tubes 33 connected into manifolds 68 at each side of the cube cutting grid (FIGS. 1 and 2). Alternatively, the cube cutting grid may be formed by a continuous tube bent to provide the grid network to avoid use of the manifolds 68. At the cube cutting grid 32, heat is released to melt the ice slabs into cubes, which sub-cools the refrigerant and makes the refrigeration system more efficient. A capillary tube 70 supplies the liquid refrigerant to the evaporator coils **26*a* and 26*b*. The refrigerant absorbs heat at the evaporator coils and the expanded refrigerant gas is returned to the compressor 56 through a suction conduit 71. The capillary tube 70 is connected into a tube member 72 having an inlet tube 74 to the evaporator coil 26*a* and an inlet tube 76 to the evaporator coil 26*b*. Hot gas is conducted from compressor 56 through tube 72 and inlet tubes 74 and 76 when the solenoid valve 60 is electrically energized. The inlet tube 76 is of larger cross sectional area than the inlet tube 74 for the purpose of conducting hot refrigerant gas to the evaporator coil 26*b* at a greater rate than hot compressed refrigerant gas is conducted through the inlet tube 72 to the evaporator coil 26*a***.

Operation of the microswitch 28 for sensing the position of the ice forming plate members 12 and 14 for controlling the refrigeration system and the water pump may be more fully appreciated from FIGS. 3, 5, 6, 7 and 8. During operation of the ice making machine, electrical power is continuously supplied to the compressor 56 to cause it to operate continuously. Electrical power is also supplied between terminals 78 and 80. When the ice forming plate members 12 and 14 are both free of ice in the maximum inclined position shown in FIGS. 5, the feeler 30 of the microswitch 28 causes the microswitch to complete a circuit through conducter 82 to energize the electrical pump 46, which delivers a flow of water over the ice forming plate members. Conductor 84 is not energized and refrigerant is conducted by solenoid valve 60 from conduit 58 to conduit 64, thus establishing a conventional refrigeration cycle to chill the ice forming plate members. Upon the formation of the slabs of ice of sufficient weight and thickness to cause the ice forming plate members 12 and 14 to pivot to the minimum inclined position shown in FIG. 6, the feeler 30 of the microswitch 28 terminates the supply of electricity to conductor 82 and supplies electricity over conductor 84 to the solenoid valve 60. The solenoid valve 60 immediately conducts hot refrigerant gas through conduit 72 to the inlets tubes 74 and 76. Since fluid inlet 76 is of slightly larger cross section than the fluid inlet 74, more hot gas flows through the evaporator coil **26*b* than flows through the evaporator coil 26*a*. The ice slab on the ice forming plate member 14 associated with the condenser coil 26*b* is first released as is shown in FIG. 7. The resulting slight upward pivoting of the plate members 12 and 14 does not alter the condition of the microswitch 28, and hot gas is continually supplied through both evaporator coils 26*a* and 26*b* until the slab of ice on the ice forming plate member 12 is released as shown in FIG. 8. With full upward pivoting of the plate members 12 and 14 to the maximum inclined position, the feeler 30 of the microswitch 28 terminates the flow of electricity through conductor 84 and supplies electricity through conductor 82. Thus, the solenoid valve 60 reverts to its unenergized state supplying hot gas from the compressor 56 through conduit 64 to the primary condenser 62 and cube cutting grid 32, and the pump 46 delivers a flow of water to the ice forming plate members. The evaporator coils 26*a* and 26*b* begin conducting heat away from the ice forming plate members to begin freezing ice slabs. The released ice slabs positioned on the cube cutting grid 32 are melted by the heat present in the cube cutting grid 32** from the refrigerant flowing in its tubes to melt the ice slab into cubes.

Due to the inclined position of the ice forming plate members and the thin film of water flowing over the ice forming plate members, the ice slabs are frozen in thicknesses which increase uniformly. Thus each ice slab is essentially of uniform thickness throughout, and the different ice slabs are of approximately the same thickness. Since the weight of the ice slabs is directly related to their thickness when pivoting of the ice forming plate members occur, the weight of the ice slabs is correlated to an approximate thickness. The desired thickness of the ice slab, and consequently of the cubes, is readily selected by positioning the counterweight member 22 along the arm members 18 and 20. The further removed the counterweight member 22 is from the pivot bar 16, the greater the thickness of the ice slab formed, since heavier ice slabs are needed to overcome the increased moment created by the counterweight. A set screw 86 retains the counterweight member 22 in a position desired.

From the foregoing description it is readily apparent that the single electrical microswitch 28 beneficially and effectively controls operation of the complete process of forming ice slabs from water and harvesting the ice slabs.

The formation of the ice slabs is essentially insensitive to humidity, temperature, altitude and other environmental influences since the ice making procedure continues in operation regardless of external conditions until slabs have attained the predetermined weight. The microswitch is highly reliable in operation over relatively long periods of time. Conducting the refrigerant gas through the cube cutting grid beneficially increases the efficiency of the refrigerant system and avoids the necessity of electric or other types of relatively unreliable cube cutting devices. The grooves in the ice forming plate members contribute to quickly releasing the slabs of ice formed on the ice forming plate members by causing the ice slabs to hydroplane. The microswitch for sensing the pivoting of the ice forming plate members secures highly desirable results: ice can be formed more rapidly since new ice slabs can be forming while the previously formed ice slabs are being cut into cubes; the thickness of the ice slabs may be readily controlled by simply adjusting the position of the counterweight member; the single electrical microswitch is relatively insensitive to external conditions such as humidity, altitude, vibrations and temperature; the single microswitch is generally considerably less expensive than other more involved control devices to considerably reduce the cost of the ice making machine; and the susceptibility of the machine to malfunction or unreliable operation is considerably reduced due to the reliability of operation.

It is apparent to those skilled in the art that the previously described elements of the ice making apparatus 10 are to be received within a housing having various frame members 88. Covers (not shown) can be attached to the frame members to enclose the ice making apparatus in an attractive cabinet and legs (not shown) support the apparatus, as is known in the art.

Although the present invention has been described with particularity, it is to be understood that the present disclosure has been made by way of example and that changes in details of structure may be made without departing from the spirit and scope of the invention.

It is claimed that:

1. In an ice making apparatus of the type having an ice forming plate member upon which a slab of ice is formed, a refrigeration system including a compressor and an evaporator coil and a condenser coil, and means for thermally connecting the evaporator coil to said ice forming plate member, an improvement comprising:

means for pivoting said ice forming plate member upon formation of the slab of ice thereon, said pivoting means operatively connecting said ice forming plate member to pivot about one end thereof, said pivoting means allowing pivoting of said ice forming plate member from a first inclined position to a second inclined position, electrical switch means for sensing a predetermined degree of pivot of said ice forming plate member away from the first inclined position, means, operatively controlled by said electrical switch means, for releasing the slab of ice from said ice forming plate member when said plate member is positioned in the second inclined position, and cube cutting grid means operatively positioned to receive the slab of ice after the slab is released from said plate member and to melt the slab of ice into a plurality of cube-like bodies, said cube cutting grid means comprising a plurality of spaced-apart and transversely extending refrigerant conducting tubes, the tubes of said cube cutting grid means comprising a portion of the condenser coil in said refrigeration system.

2. Apparatus for harvesting a slab of ice formed on an ice forming plate member in an ice making machine, comprising:

means for pivoting said ice forming plate member, means associated with said ice forming plate member for supplying a control signal upon said ice forming plate member pivoting a predetermined degree, said means for supplying a control signal comprising switch means operatively positioned to sense pivoting of said ice forming plate member, means operatively attached to said ice forming plate member to resist pivoting, a second ice forming plate member operatively attached to pivot with the ice forming plate member first aforesaid, and means controlled by receipt of said control signal for heating said second ice forming plate member by a different amount than said first ice forming plate member is heated to release the slab of ice from the second ice forming plate member at a different time than the slab of ice is released from the first ice forming plate member.

3. In an ice making apparatus of the type having an ice forming plate member upon which a slab of ice is formed, a refrigeration system including a compressor and an evaporator coil and a condenser coil, and means for thermally connecting the evaporator coil to said ice forming plate member, an improvement comprising:

means for pivoting said ice forming plate member upon formation of the slab of ice thereon, said pivoting means operatively connecting said ice forming plate member to pivot about one end thereof, said pivoting means allowing pivoting of said ice forming plate member from a first inclined position to a second inclined position, electrical switch means for sensing a predetermined degree of pivot of said ice forming plate member away from the first inclined position and for supplying an electrical control signal in response thereto, means, operatively controlled by said electrical switch means, for releasing the slab of ice from said ice forming plate member when said plate member is positioned in the second inclined position, cube cutting grid means operatively positioned to receive the slab of ice after the slab is released from said plate member and to melt the slab of ice into a plurality of cube-like bodies, said cube cutting grid means comprising a plurality of spaced-apart and transversely extending refrigerant conducting tubes, the tubes of said cube cutting grid means being operatively connected in said refrigeration system, and electrically controlled valve means connected in said refrigeration system for supplying hot refrigerant gas to the evaporator coil upon receipt of the control signal and for operatively conducting refrigerant through the tubes of said cube cutting means upon the absence of said control signal.

4. Apparatus for forming ice cubes from water comprising:

a first ice forming plate member operatively connected to pivot about one end thereof, a second ice forming plate member operatively connected to pivot about one end thereof, means for selectively delivering a flow of water over said first and second ice forming plate members, means for selectively conducting heat energy away from said ice forming plate members to freeze at least a portion of the water flowing thereover and form slabs of ice thereon, means associated with said ice forming plate members for supplying a control signal in response to a predetermined pivoting of said ice forming plate members, the pivoting being directly related to the weight of ice formed on said plate members, means operative upon receipt of the control signal for terminating the delivery of water to said ice forming plate members, means operative upon receipt of the control signal for conducting heat energy to said ice forming plate members to release the slabs of ice formed thereon, and means positioned to receive the slabs of ice released for cutting the ice slabs into cubes.

5. Apparatus as recited in claim 4 wherein:

said second ice forming plate member is positioned essentially parallel to and vertically with respect to said first ice forming plate member.

6. Apparatus as recited in claim 4 further comprising:

means for biasing said ice forming plate members to resist pivoting prior to formation of ice slabs of predetermined weight thereon.

7. Apparatus as recited in claim 6 wherein said biasing means comprise:

an arm member operatively connected to said ice forming plate members and extending away from said ice forming plate members at the pivotably connected ends, and a counterweight member attached to said arm member at a predetermined position.

8. Apparatus as recited in claim 6 wherein said means for supplying a control signal comprise an electrical switch.

9. Apparatus as recited in claim 8 further comprising:

a refrigeration system comprising a compressor and a condenser coil and evaporator coil, an electrically controlled solenoid valve connected in the refrigeration system in a flow of compressed gas from the compressor, and an electrically controlled water pump; and wherein:

said electrical switch is operative to selectively terminate operation of the water pump and simultaneously operate the solenoid valve.

10. Apparatus as recited in claim 9 wherein:

said means for selectively conducting heat energy away from said ice forming plate members comprise portions of the evaporator coil of the refrigeration system, a portion of the evaporator coil being attached in heat conductive relationship with each ice forming plate member;

said means for cutting the ice slab into cubes comprise at least a portion of the condenser coil of the refrigeration system, the condenser coil being formed in a grid like array;

said means for conducting heat energy to said ice forming plate members comprising conduit members connecting the solenoid valve with the evaporator coils, the conduit member connected to the evaporator coil portion associated with said first ice forming plate member being larger in cross sectional area than the conduit member connected to the evaporator coil portion associated with said second ice forming plate member.

11. Apparatus as recited in claim 4 wherein said ice forming plate member has a surface upon which the ice slab is formed, and said surface includes a plurality of grooves formed parallel with the direction of release of the ice slab.

* * * * *